United States Patent [19]

Ferch

[11] 4,034,932

[45] July 12, 1977

[54] METHODS FOR IMPARTING A GROOVED SURFACE TO CABLE DRUM SHELLS

[76] Inventor: Alois Ferch, Fischer-Str. 9, D4040 Neuss, Rhineland, Germany

[21] Appl. No.: 676,506

[22] Filed: Apr. 13, 1976

[30] Foreign Application Priority Data

Apr. 18, 1975 Germany ..... 2517089

[51] Int. Cl.[2] ..... B65H 75/14; B65H 75/34

[52] U.S. Cl. ..... 242/117

[58] Field of Search ..... 242/117, 54 R, 155 BW; 254/190; 29/428

[56] References Cited

U.S. PATENT DOCUMENTS

| | | | |
|---|---|---|---|
| 2,204,938 | 6/1940 | Le Bus | 242/117 |
| 2,599,926 | 6/1952 | Le Bus | 242/117 |
| 2,954,702 | 10/1960 | Petersen | 242/117 X |

*Primary Examiner*—George F. Mautz

*Attorney, Agent, or Firm*—Mandeville and Schweitzer

[57] ABSTRACT

Methods are provided for imparting a grooved surface to cable drums for winding in spaced fashion rope, wire or cable onto the drum surface without the need for expensive machining operations. This is achieved by providing elongated strands of material, preferably comprised of a synthetic thermoplastic resin, with the strands having a cross sectional profile which includes a rope-receiving groove on one surface thereof. Subsequently, one or more lengths of the strands are coiled and fastened to the drum core surface to impart thereto a continuous groove for receiving the rope or cable coiled thereon. The side edges of the strand profile may be configured so that when coiled on the drum surface, adjacent side edges of the coil interlock so as to maintain adjacent coils firmly in place against each other. Moreover, the strands forming the grooved drum surface may incorporate wire mesh, wire, or metal or textile webs to reduce elongation thereof in use.

15 Claims, 6 Drawing Figures

Fig.1
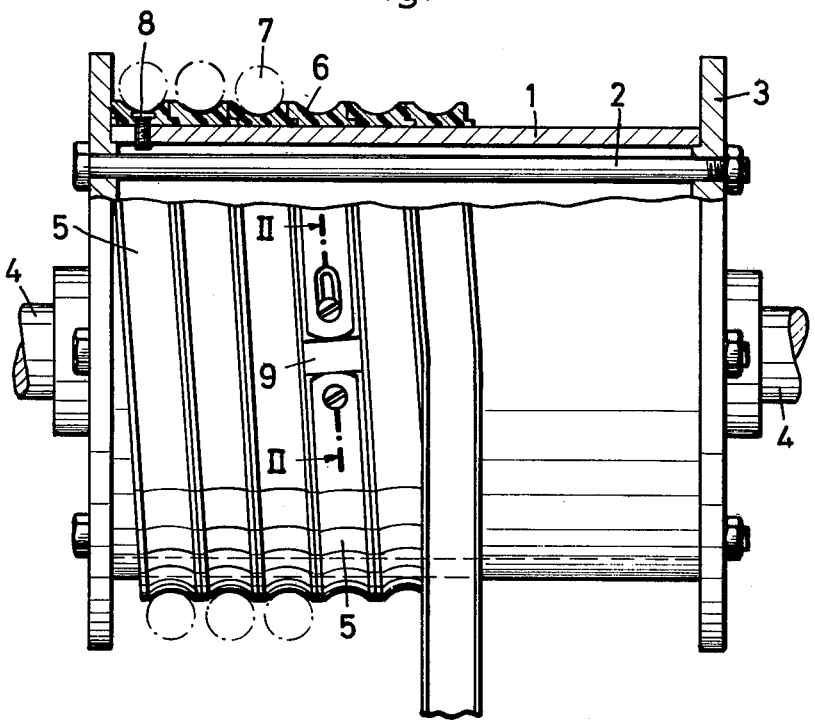
Fig.3
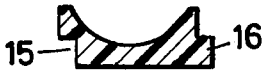
Fig.4
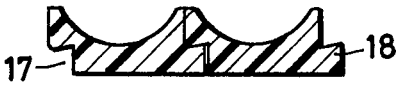
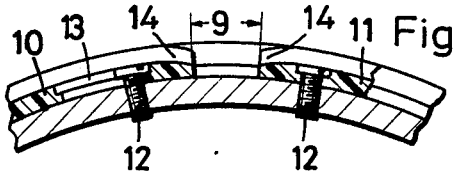
Fig.2
Fig.5
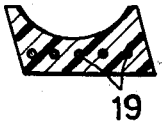
Fig.6
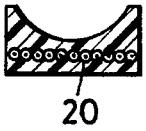

METHODS FOR IMPARTING A GROOVED SURFACE TO CABLE DRUM SHELLS

BACKGROUND AND STATEMENT OF THE INVENTION

The invention is directed to a method for manufacturing a grooved cable drum shell, particularly for cable winches, reels, etc. to be wound with one or several layers. It is known, particularly for cable winches, to groove the drum shell in such a way that the wound cable is coiled with the individual strands spaced apart from each other 1 to 3 mm. This eliminates friction between adjacent coils during winding and unwinding. It is especially important to reduce the risk of wear in this manner when dealing with very long cables.

The grooving of the drum shell is generally done by means of machine tools. This method is very expensive and time-consuming, particularly on large drums, due to the large amount of waste material. Also, expensive machine tools must be employed for this kind of work. In order to eliminate this problem, it has been suggested to wrap a cylindrical metallic drum shell core with a synthetic shell consisting of two cast, sprayed or pressed half shells, the exterior of such synthetic shell being provided with the appropriate grooves. This design for a grooved drum surface, however, is only rarely used as it is only practical for the manufacture of large quantities of small and medium sized drum shells in one production run. Moreover, since each mold can only be utilized for a certain drum diameter with a certain drum width and groove shape, the costs for tools and molds increase substantially as dimensions increase.

The invention is directed to a method for providing grooved surfaces for cable drums which is faster and, above all, cheaper than the conventional machining of grooves, and which may nevertheless be utilized for drums of all sizes, as well as different shapes of grooves, and even for small production runs. The invention provides a profiled rope or strand which is wound helically onto a cylindrical drum core, with one surface being provided with at least one longitudinal groove for rope and/or cable to be wound; and to fasten it to the drum shell core. This method permits the grooving at a fraction of conventional costs, at less time, and with practically no waste of material.

The profiled strand is connected in a detachable fashion at or near its ends with the shell core. This detachable connection, which is preferably done by means of screws, not only facilitates replacement of a worn strand with a profiled strand of the same type, but also allows for substitution of a profiled strand with a wider, slimmer or even double flute, if circumstances call for it.

Preferably, the strands of the invention are injection molded of a synthetic thermoplastic resin, although metal strands which are cast or extruded may be used also. The synthetic strands, however, are preferable, due to their much lighter weight and easier machinability. As the strands may be formed into very long lengths, coiled in bundles, waste is kept to a minimum.

It has been found appropriate, in accordance with the invention, to utilize at least two lengths of the profiled strands of the invention to provide a helically grooved surface on a drum core. By using more than one strand, a space may be provided where the ends of the two lengths join to accommodate longitudinal displacement or expansion of the strands on the core surface. To that end, the adjacent ends of the joined strands may be affixed to the drum surface through elongated holes or slots to accommodate this movement. Alternatively, one single, extremely long profiled strand may be attached to the drum shell core at proper intervals by means of two spaced apart screws, and thereafter a piece cut from the profiled strand between these two screws, the length of such piece corresponding to about the length of expansion expected from the separated profiled strand. In this manner, it is possible to wrap the drum shell core much faster and more exactly than would be possible with several shorter profiled strand sections. Preferably, the strands are reinforced by incorporating metal wire, metal strips or by textile or metal webs in order to reduce this expansion as much as possible.

The cross sections chosen as strand profiles may vary widely. One such strand profile, for example, is provided on one side with a continuous longitudinal slot, with the upper surface thereof tapering downwardly toward the edge in a wedge shape, whereas the other narrow side is provided with a corresponding integral ledge with an upper surface tapering upwardly toward the exterior in a wedge shape. When winding such a profiled strand, the adjacent sides are pressed firmly together due to the effect of the wedges, so that the coils are wedged together. Each strand coil is, therefore, tightly connected with its two neighboring coils laterally, while length expansion is not obstructed in any way. Other side edge profiles may be used to that end.

Before describing the invention in more detail, it may be well to note that various synthetic thermoplastics may be used to produce the strands of the invention, as will be understood by practitioners in the art, including, for example, polyesters and polyamides. With the foregoing objects in view, this invention will now be described in more detail, and other objects and advantages thereof will be apparent from the following detailed description of illustrative embodiments, the accompanying drawings and the appended claims.

DESCRIPTION OF THE DRAWINGS

FIG. 1 is a plan view partially in section of a cable winch drum during coiling, said drum embodying aspects of the invention;

FIG. 2 is an enlarged sectional view taken along lines II—II of FIG. 1;

FIG. 3 is a cross sectional view of one embodiment of the strand of the invention;

FIG. 4 is a cross sectional view of two coils of the strand embodiment of FIG. 3 joined together;

FIG. 5 is a cross sectional view of a further embodiment of the strand of the invention, showing a different profile and reinforced with metal wires; and FIG. 6 is a cross sectional view of a still further embodiment of the strand of the invention, showing a straightsided profile and reinforced with a webbing.

DETAILED DESCRIPTION OF THE INVENTION

Referring to the drawings, in which like references refer to like parts throughout the several views thereof, the simple cable winch drum shown in FIG. 1, which serves only as an example, can be disassembled and consists essentially of drum shell core 1 fastened between two end walls 3 by means of iron ties 2. The end walls 3 are provided with a hub bore hole to accommodate a continuous drive shaft 4 which is non-rotatably connected with at least one of the two end walls 3. The profiled coiled strand 5 is provided on its exterior with a longitudinal groove 6, for a rope or cable 7 shown in dot-dash line to be wound. One end of profiled strand 5 is screwed to the drum shell core 1 by any means, such as, a flathead screw 8. Coiling of strand 5 on core 1 is done, preferably, on a spindle bench.

As may be seen in FIG. 1, the grooving can be effected by coiling two or more shorter strands or one single long profiled strand. In the latter case, the distances 9 serve to compensate for possible maximum elongation, in conjunction with elongated tap holes and passage holes and/or slots 13 for the screws 12 serving to fasten the ends 10, 11 of the profiled strands. The holes 13 and spacing 9 may be introduced after coiling onto the core. This very much simplifies all operations. Finally, those pieces of the strand that correspond to distances 9 are cut out, and the cut edges 14 of strand ends 10, 11 are rounded off to reduce wear on rope 7.

FIG. 3 shows a cross section of the profiled strand 5, shown in FIG. 1 enlarged, showing in detail a slot 15, and ledge 16 so that adjacent strands overlap somewhat and are held together. FIG. 4 shows a similar strand profile with two coils joined together. In this embodiment, the cross section of slot 17 tapers downwardly in a wedge shape toward the outside, while the corresponding cross section of ledge 18 tapers upwardly in a wedge shape toward the outside. This has the advantage of having each coil splined or dovetailed, so to speak, with adjacent coils. FIG. 5 shows a rhomboid strand cross section.

The cross sections according to FIGS. 3 through 5, as well as the rectangular cross section according to FIG. 6, are suitable for coiling either clockwise or counterclockwise. All it takes is to start at the proper end of the profiled strand for the coiling operation. In order to keep the expansion of a profiled strand 5 comprised of a thermoplastic resin within limits, it may incorporate metal wires 19, a metal strip, or webs 20. Webs 20 may be comprised of a metal or textile material to provide the desired reinforcement.

While the methods and forms of apparatus herein disclosed form preferred embodiments of the invention, the invention is not to be considered limited to these specific methods and forms of apparatus, and changes can be made therein without departing from the scope of the invention, which is defined in the appended claims.

I claim:

1. A method for manufacturing a cable drum with a grooved surface for use in cable winches and the like, characterized by the steps of
   a. providing a cable drum core;
   b. coiling helically an elongated strand of flexible material onto said core surface; the outside surface of said elongated strand having a longitudinal groove therealong;
   c. attaching said elongated strand to said drum surface at points intermediate the ends thereof;
   d. said attaching step including attaching said strand at said points by two spaced apart attaching means;
   e. cutting out that portion of said elongated strand between said spaced apart attaching means; and
   f. providing the areas of said strands adjacent said attaching means with openings allowing relative longitudinal movement between said attaching means and said elongated strand.

2. The method of claim 1, further characterized by
   a. the ends of said strand being detachably affixed to said core.

3. The method of claim 1, further characterized by
   a. said elongated strand being comprised of a synthetic thermoplastic material.

4. The method of claim 1, further characterized by
   a. said coiling step including helically coiling at least two lengths of said elongated strand material on said drum core;
   b. the ends of said two lengths being detachably secured to said drum core surface; and
   c. adjacent ends of said two strands being longitudinally displaceably attached and spaced from each other.

5. The method of claim 1, further characterized by
   a. said elongated strand is reinforced with metallic wire, metallic strips, metallic webs or textile webs.

6. A method for manufacturing a cable drum with a grooved surface for use in cable winches and the like, characterized by the steps of
   a. providing a cable drum core;
   b. coiling helically an elongated strand of flexible material onto said core surface, the outside surface of said elongated strand having a longitudinal groove therealong;
   c. affixing the ends of said strand to said core;
   d. said elongated strand having a longitudinal slot along one side edge thereof and a longitudinal integral extension along the other side edge; and
   e. said slot and said extension cooperating during said coiling step to hold adjacent coils of said strand together.

7. The method of claim 6, further characterized by
   a. the top of said slot being tapered downwardly toward the outside edge thereof, and the top of said extension being tapered upwardly toward the outside edge thereof for lateral locking engagement therebetween.

8. A cable drum with a grooved surface for winding a cable or the like onto the drum surface with the individual coils of said cable being held in spaced relation to each other, characterized by
   a. a drum core;
   b. an elongated strand of material helically wound on said core surface;
   c. the upper surface of said strand being contoured to provide a longitudinally extending groove therealong;
   d. means for attaching the ends of said elongated strand to said core surface; and
   e. said attaching means including means providing relative longitudinal movement between said strand ends and said attaching means.

9. The apparatus of claim 8, further characterized by
   a. said elongated strand of material including at least two lengths of said strand;
   b. said attaching means including means for attaching said strand lengths to said drum surface; and
   c. said attaching means including means for attaching adjacent ends of said lengths in spaced relation to each other and providing relative longitudinal movement in relation to each other.

10. The apparatus of claim 8, further characterized by
   a. said attaching means including longitudinally extending slots in said strand adjacent the ends thereof, allowing relative longitudinal displacement between said strand and said attaching means.

11. The apparatus of claim 9, further characterized by a. said attaching means including longitudinally extending slots in said strand lengths adjacent the ends thereof, allowing relative longitudinal displacement between adjacent strand length ends and between said strand lengths and said attaching means.

12. The apparatus of claim 8, further characterized by a. said elongated strand being comprised of a synthetic thermoplastic material.

13. The apparatus of claim 8, further characterized by a. said elongated strand being reinforced with metallic wire, metallic strips, metallic webs, or textile webs.

14. The apparatus of claim 8, further characterized by a. said elongated strand having a longitudinal slot along one side edge thereof and a longitudinal extension along the other side edge; and b. said slot and said extension cooperating to hold adjacent coils of said strand together.

15. The apparatus of claim 14, further characterized by a. the top of said longitudinally extending slot being tapered downwardly toward the outside edge thereof; and b. the top of said longitudinally extending extension being tapered upwardly toward the outside edge thereof for lateral locking engagement with said tapered slot.

* * * * *